US010187728B2

(12) United States Patent
Oliveira et al.

(10) Patent No.: US 10,187,728 B2
(45) Date of Patent: Jan. 22, 2019

(54) ACOUSTIC ENCLOSURE COMPRISING A NON-HEAT-CONDUCTING EXTERNAL WALL, AN ELECTRODYNAMIC LOUDSPEAKER AND AN ELECTRONIC CONTROL CIRCUIT

(71) Applicant: DEVIALET, Paris (FR)

(72) Inventors: Antonio Oliveira, Puteaux (FR); Emmanuel Nardin, Vanves (FR); Pierre-Emmanuel Calmel, Le Chesnay (FR); Julien Bergère, Versailles (FR)

(73) Assignee: Devialet, Paris (FR)

( * ) Notice: Subject to any disclaimer, the term of this patent is extended or adjusted under 35 U.S.C. 154(b) by 0 days.

(21) Appl. No.: 15/105,809

(22) PCT Filed: Dec. 16, 2014

(86) PCT No.: PCT/EP2014/077907
§ 371 (c)(1),
(2) Date: Jun. 17, 2016

(87) PCT Pub. No.: WO2015/091446
PCT Pub. Date: Jun. 25, 2015

(65) Prior Publication Data

US 2016/0337756 A1 Nov. 17, 2016

(30) Foreign Application Priority Data

Dec. 18, 2013 (FR) ..... 13 62924

(51) Int. Cl.
*H04R 1/28* (2006.01)
*H04R 3/00* (2006.01)
*H04R 9/02* (2006.01)

(52) U.S. Cl.
CPC ..... *H04R 9/022* (2013.01); *H04R 1/2826* (2013.01); *H04R 3/007* (2013.01); *H04R 2201/028* (2013.01)

(58) Field of Classification Search
CPC ..... H04R 9/022; H04R 1/02; H04R 1/025
See application file for complete search history.

(56) References Cited

U.S. PATENT DOCUMENTS 4,811,403 A * 3/1989 Henricksen ..... H04R 1/02 181/152
5,771,154 A 6/1998 Goodman et al.
(Continued)

FOREIGN PATENT DOCUMENTS

WO WO 88/10054 A1 12/1988

OTHER PUBLICATIONS

International Search Report for PCT/EP2014/077907, dated Mar. 13, 2014.

*Primary Examiner* — Matthew A Eason
(74) *Attorney, Agent, or Firm* — Knobbe, Martens, Olson & Bear, LLP

(57) ABSTRACT

An acoustic enclosure (1), comprising:
- a non-heat-conducting external wall (20) at least partially defining a casing (25),
- at least one electrodynamic loudspeaker (5) including a motor (48), the loudspeaker having a peripheral portion (50) fastened on the external wall, and
- at least one electronic control circuit (10) of the loudspeaker.

The motor and the electronic circuit are connected to a same member (15) of the acoustic enclosure. The member conducts heat and includes an exchange surface (66) able to be traversed by a heat flow (68) circulating in the member originating from the motor and the electronic circuit when the acoustic enclosure is operating, the heat flow being
(Continued)

intended to dissipate in the air (76) outside the acoustic enclosure or to pass into a heat-conducting element outside the acoustic enclosure.

11 Claims, 2 Drawing Sheets

(56) References Cited

U.S. PATENT DOCUMENTS

| | | | | |
|---|---|---|---|---|
| 6,259,798 | B1 * | 7/2001 | Perkins | H04R 1/02 181/199 |
| 6,373,957 | B1 * | 4/2002 | Stewart | H04R 9/022 381/397 |
| 7,120,270 | B2 * | 10/2006 | Aronson | H04R 9/022 381/397 |
| 9,872,107 | B2 * | 1/2018 | Kochendoerfer | H04R 9/022 |
| 2005/0169494 | A1 | 8/2005 | Stiles et al. | |
| 2012/0230499 | A1 * | 9/2012 | Suzuki | H04R 1/025 381/55 |
| 2013/0083958 | A1 * | 4/2013 | Katz | G10K 11/004 381/412 |
| 2013/0213730 | A1 * | 8/2013 | Litovsky | H04R 1/02 181/199 |
| 2018/0035187 | A1 * | 2/2018 | Cook | F21V 33/0056 |

* cited by examiner

ACOUSTIC ENCLOSURE COMPRISING A NON-HEAT-CONDUCTING EXTERNAL WALL, AN ELECTRODYNAMIC LOUDSPEAKER AND AN ELECTRONIC CONTROL CIRCUIT

CROSS-REFERENCE TO RELATED APPLICATIONS

This application is the U.S. National Phase under 35 U.S.C. § 371 of International Application PCT/EP2014/077907, filed Dec. 16, 2014, which claims priority to FR 13 62924, filed Dec. 18, 2013.

BACKGROUND OF THE INVENTION

(1) Field of the Invention

The present invention relates to an acoustic enclosure, comprising:

- a non-heat-conducting external wall at least partially defining a casing of the acoustic enclosure,
- at least one electrodynamic loudspeaker including a motor, the loudspeaker having a peripheral portion fastened on the external wall, and
- at least one electronic control circuit of the loudspeaker.

(2) Description of Related Art

Such a device is typically described as an "active acoustic enclosure". In general, these elements are contained in a substantially airtight casing with respect to the air outside the acoustic enclosure. Yet both the electronic circuit and the loudspeaker(s) give off heat when the acoustic enclosure is operating. For example, the electric circuit typically gives off between 40 watts and 300 watts depending on the usage level. By using very high performing power supply and amplification technologies, the power given off is instead from 20 W to 50 W.

The loudspeaker(s) typically give off up to 100 W of heat, for 1000 W of electricity received at its peak. Furthermore, the acoustic enclosure is generally used over a fairly long length of time.

There is thus a risk of overheating of the internal components of the enclosure due to heating of the inside air. The electronic circuit may be damaged if the temperature of its components for example exceeds 65° C. Likewise, the spool of a loudspeaker may be damaged if its temperature for example exceeds 200° C. Furthermore, the neodyme magnets generally present in the motor of the loudspeaker may undergo a permanent loss of power if their temperature exceeds about 80° C.

To resolve these drawbacks, it is known to connect a heat sink to the electronic circuit. The heat sink is placed inside the acoustic enclosure. The heatsink ensures a rapid heat exchange between the electronic circuit and the air inside the acoustic enclosure. Such a solution partially resolve the problem of heating of the electronic circuit, but it is only appropriate for a relatively low-power acoustic enclosure.

It is also known to use a heat sink placed outside the acoustic enclosure and connected to the electronic circuit. This ensures cooling of the electronic circuit, but a risk remains of heating of the loudspeakers and the air inside the acoustic enclosure.

Likewise, it is known to fasten a radiator behind the loudspeaker, in the casing of the acoustic enclosure. Such a solution does not make it possible to dissipate a significant thermal power, and heating of the air inside the acoustic enclosure is observed.

It is also known to produce an acoustic enclosure whereof the external walls conduct heat. The external walls are for example made from metal. In general, these walls are thermally insulated from the loudspeakers by a seal providing acoustic sealing. The cooling time constants of the loudspeakers are high, approximately several hours.

Also known are so-called "bass reflex" acoustic enclosures, which provide an air exchange with the outside and therefore allow cooling of the inside air, in particular during strong movements of the membrane of the loudspeaker. It is known to place a heat sink of the electronic circuit near the port, so as to maximize the heat exchanges with the outside.

It is also known to protect the electronic circuit by using heat sensors to limit the thermal power transmitted by the electronic circuit to the loudspeakers, or to stop the electronics or place them in standby until the electronic circuit has cooled to acceptable temperatures.

However, these technical solutions do not completely eliminate the risk of overheating, in particular during use of the acoustic enclosure at very high power. These technologies lead to temporarily or permanently limiting the power of the acoustic enclosure.

One aim of the invention is therefore to provide an acoustic enclosure as described above and that is not limited, or is less limited, in terms of power due to the heating of its internal components.

BRIEF SUMMARY OF THE INVENTION

To that end, the invention relates to an acoustic enclosure comprising:

- a non-heat-conducting external wall at least partially defining a casing of the acoustic enclosure,
- at least one electrodynamic loudspeaker including a motor, the loudspeaker having a peripheral portion fastened on the external wall, and
- at least one electronic control circuit of the loudspeaker, wherein the motor of the loudspeaker and the electronic circuit are connected to a same member of the acoustic enclosure, the member conducting heat and including an exchange surface able to be traversed by a heat flow circulating in the member originating from the motor and the electronic circuit when the acoustic enclosure is operating, the heat flow being intended to dissipate in the air outside the acoustic enclosure or to pass into a heat-conducting element outside the acoustic enclosure.

According to specific embodiments, the acoustic enclosure includes one or more of the following features, considered alone or according to any technically possible combination(s):

- the loudspeaker motor is fastened on the member directly or by means of a chassis of the loudspeaker;
- the motor of the loudspeaker or the electronic circuit is or are connected to the member by at least one thermal bridge;
- the member includes a radiator defining at least part of the exchange surface, and a connecting portion, preferably made from metal, to which the motor of the loudspeaker and the electronic circuit are connected, the connecting portion being connected to the radiator directly or via a thermal bridge;
- the connecting portion is at least 80 wt % made from metal;

the connecting portion extends to the inside of the casing, in particular through the casing;

the connecting portion is at least partially situated on the surface of the acoustic enclosure so as to partially form the casing;

the member inwardly defines at least one passage through the acoustic enclosure, the passage including at least one inlet for outside air, and an outlet, the passage being suitable for allowing a circulation of outside air from the inlet toward the outlet, and the member preferably comprising fins to favor a dissipation of the heat flow in the outside air circulating in the passage;

the acoustic enclosure comprises a fan to create a forced circulation of outside air in the passage; and the external wall is further fastened on the member, the loudspeaker, the external wall and the member defining a substantially airtight inner volume with respect to the outside air.

BRIEF DESCRIPTION OF THE SEVERAL VIEWS OF THE DRAWINGS

The invention will be better understood upon reading the following description, provided solely as an example and done in reference to the appended drawings, in which.

DETAILED DESCRIPTION OF THE INVENTION

Figure 1:
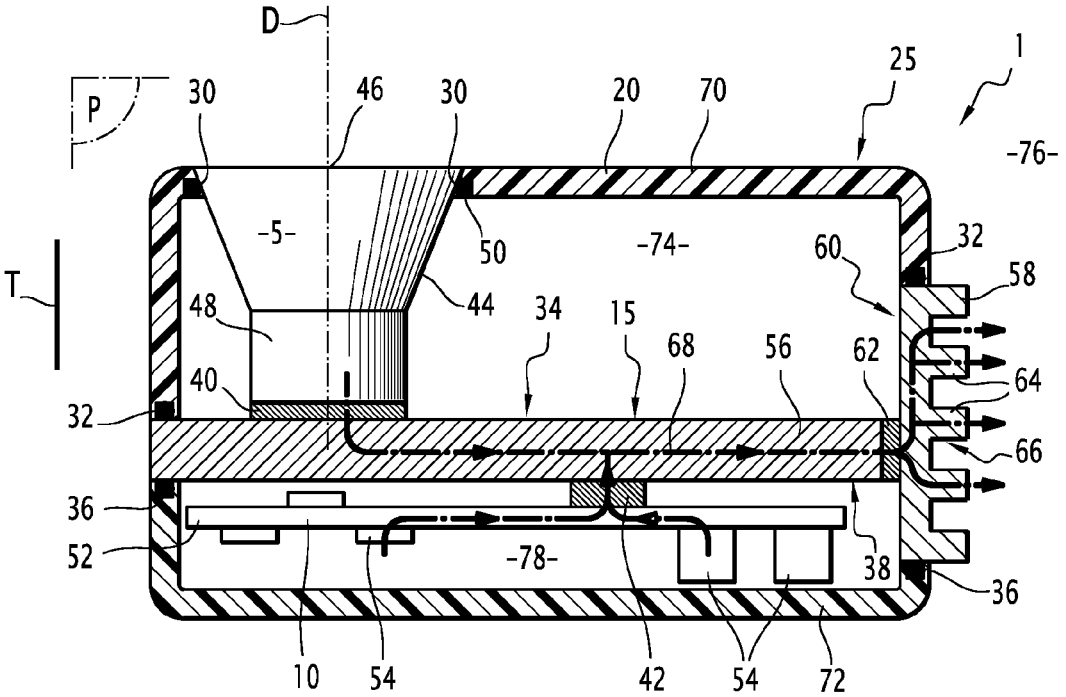
FIG. 1 is a sectional diagrammatic view of an acoustic enclosure according to a first embodiment of the invention.

In reference to FIG. 1, a loudspeaker enclosure 1 is described according to a first embodiment of the invention.

FIG. 1 is a sectional view along a plane P that is for example horizontal when the acoustic enclosure 1 is set on a horizontal surface (not shown) or fastened on a wall (not shown).

In the illustrated example, the acoustic enclosure 1 has a generally substantially parallelepiped shape. Alternatively, the acoustic enclosure 1 has another general shape, advantageously substantially spherical.

The acoustic enclosure 1 comprises a loudspeaker 5, an electronic control circuit 10 of the loudspeaker 5, a heat-conducting member 15, and a non-heat-conducting external wall 20 at least partially defining the casing 25 of the acoustic enclosure.

The acoustic enclosure 1 further comprises a sealing gasket 30 inserted between the loudspeaker 5 and the external wall 20, a sealing gasket 32 inserted between the external wall 20 and a first face 34 of the member 15, and a sealing gasket 36 inserted between the external wall 20 and a second face 38 of the member 15, opposite the first face 34 along a transverse direction T of the acoustic enclosure 1. The acoustic enclosure 1 also comprises a first thermal bridge 40 connecting the loudspeaker 5 and the member 15, and a second thermal bridge 42 connecting the electronic circuit 10 and the member 15.

The loudspeaker 5 comprises a chassis 44, a membrane 46, and a motor 48. The motor 48 is able to give off heat when the acoustic enclosure 1 is operating. The motor 48 includes a spool defining an axis D of the loudspeaker 5 for example substantially parallel to the transverse direction T. The motor 48 is fastened on the member 15 via the first thermal bridge 40.

"Thermal bridge" between two parts refers to one or several elements connecting the two parts and suitable for conducting heat in one direction or the other between the two parts. For example, the elements of the thermal bridge are suitable for the thermal resistance between the two parts to be less than or equal to 5° C./W, preferably less than or equal to 3° C./W, still more preferably less than or equal to 1° C./W. The main material making up the thermal bridge advantageously has a thermal conductivity greater than or equal to 1 W/m·K.

According to alternatives (not shown), the chassis 44 or the motor 48 are fastened directly on, or are in clean contact with, the member 15.

The chassis 44 includes a peripheral portion 50 relative to the axis D and fastened on the external wall 20, advantageously over the entire perimeter of the loudspeaker 5 around the axis D.

For example, the membrane 46 is substantially planar, or substantially forms a sphere portion. The membrane 46 is suspended from the chassis 44, advantageously by the sealing gasket 30.

The electronic circuit 10 for example comprises a printed circuit 52 fastened on the second thermal bridge 42, and electronic components 54 mounted on the printed circuit 52.

The printed circuit 52 is for example substantially parallel to a connecting portion 56 of the member 15.

The electronic components 54 are able to give off heat when the acoustic enclosure 1 is operating.

In the illustrated example, the member 15 extends inside and through the casing 25, for example substantially perpendicular to the axis D of the loudspeaker 5. The member 15 comprises the connecting portion 56, a radiator 58 positioned in an opening 60 of the casing 25, and a third thermal bridge 62 connecting the connecting portion and the radiator.

According to alternatives (not shown), the third thermal bridge 62 is replaced by a clean contact between the connecting portion 56 and the radiator 58, or by a paste or grease.

The connecting portion 56 for example has a generally planar shape. The connecting portion 56 is for example substantially perpendicular to the axis D of the loudspeaker 5. The connecting portion 56 is for example made from metal, advantageously aluminum, magnesium or steel. The connecting portion 56 is for example a single piece.

According to one alternative that is not shown, the member 15 is made in a single piece.

The radiator 58 for example extends in a plane substantially perpendicular to the connecting portion 56. The radiator 58 advantageously includes fins 64 protruding toward the outside of the acoustic enclosure 1. The radiator 58 defines an exchange surface 66 able to be traversed by a heat flow 68 circulating in the member 15 originating from the motor 48 and the electronic circuit 10 when the acoustic enclosure 1 is operating.

"Conductive" means that the member 15 has, at least over the journey of the heat flow 68, a conductivity $\lambda$ greater than or equal to 1 W/m·K.

In the illustrated example, the external wall 20 comprises two half-shells 70, 72.

"Non-heat-conducting" or "thermally insulating" refers to a material having a heat conductivity λ strictly less than 1 W/m·K.

The half-shell 70 is fastened on the peripheral portion 50 of the loudspeaker 5 and on the first face 34 of the member 15.

The half-shell 72 is fastened on the second face 38 of the member 15.

Owing to the sealing gaskets 30, 32, the loudspeaker 5, the member 15 and the external wall 20 define a first substantially airtight inner volume 74 with respect to the outside air 76. The half-shell 72 and the member 15 define a second substantially airtight inner volume 78 with respect to the outside air 76.

In the illustrated example, the first inner volume 74 houses the motor 48. The second volume 78 houses the electronic circuit 10.

The operation of the acoustic enclosure 1 will now be described.

The member 15 places the motor 48, the electronic circuit 10 and the outside air 76 in thermal communication.

When the acoustic enclosure 1 is operating, the motor 48 and the electronic circuit 10 give off heat. In steady-state, the heat given off by the motor 48 passes in the member 15 via the first thermal bridge 40. The heat given off in the electronic circuit 10 passes in the member 15 via the second thermal bridge 42. The heat flow 68 originating from the motor 48 and the electronic circuit 10 is created in the member 15. The heat flow 10 traverses the third thermal bridge 62 and arrives in the radiator 58. The heat flow 10 then traverses the exchange surface 66 to dissipate in the outside air 76.

Owing to the features described above, in particular the member 15, it is possible to extract a large fraction of the heat that is given off in the motor 48 and in the electronic circuit 10, and to discharge it outside the acoustic enclosure 1. It is thus possible to prevent excessive heating of the motor 48 or the electronic circuit 10.

Furthermore, at the beginning of use of the acoustic enclosure 1, the loudspeaker 5 is heated by the electronic circuit 10. Indeed, the heat given off by the electronic circuit 10 is conducted by the second thermal bridge 42, the member 15 and the first thermal bridge 40 to the motor 48. The motor 48 gives off little or no heat as long as the sound volume of the acoustic enclosure 1 remains low. Indeed, the power consumed 'at rest' by the electronic circuit is non-null, therefore for null or low sound volumes, the majority of the heat production occurs at the electronic circuit.

Furthermore, owing to the member 15, it is possible to make the casing 25 from a material other than metal, while correctly discharging the heat given off by the motor 48 and the electronic circuit 10.

Advantageously, the member 15 constitutes an inner framework of the acoustic enclosure 1, on which the external wall 20 of substantially tight material is fastened.

An acoustic enclosure 100 making up a second embodiment of the invention will now be described in reference to FIGS. 2 and 3.

The acoustic enclosure 100 is similar to the acoustic enclosure 1 shown in FIG. 1. In FIGS. 2 and 3, similar elements bear the same numerical references. Only the differences between the acoustic enclosure 100 and the acoustic enclosure 1 will be described in detail below.

The acoustic enclosure 100 comprises a second loudspeaker 105, and a second electronic circuit 110 for controlling the second loudspeaker 105.

The second loudspeaker 105 is advantageously structurally similar to the loudspeaker 5. The second loudspeaker 105 in particular comprises a motor 148 able to give off heat when the acoustic enclosure 100 is operating. The second loudspeaker 105 is for example positioned on the other side of the member 15 relative to the loudspeaker 5.

The motor 148 is connected to the member 15 by a fourth thermal bridge 140.

The electronic circuit 10 is situated in the inner volume 74. The electronic circuit 10 is connected to the first face 34 of the member 15 via the second thermal bridge 42.

The second electronic circuit 110 is situated in the second inner volume 78. The second electronic circuit 110 is connected to the member 15 by a fifth thermal bridge 142.

The fifth thermal bridge 142 is for example fastened on the second face 38 of the member 15.

In the illustrated example, the member 15 occupies a substantially median position in the casing 25 along the transverse direction T.

The first electronic circuit 10 and the second electronic circuit 110 are for example connected by cables 112.

The member 15 of the acoustic enclosure 100 for example has no radiator extending in an opening defined by the casing 25. The member 15 inwardly defines a passage 114 through the acoustic enclosure 100.

Figure 3:
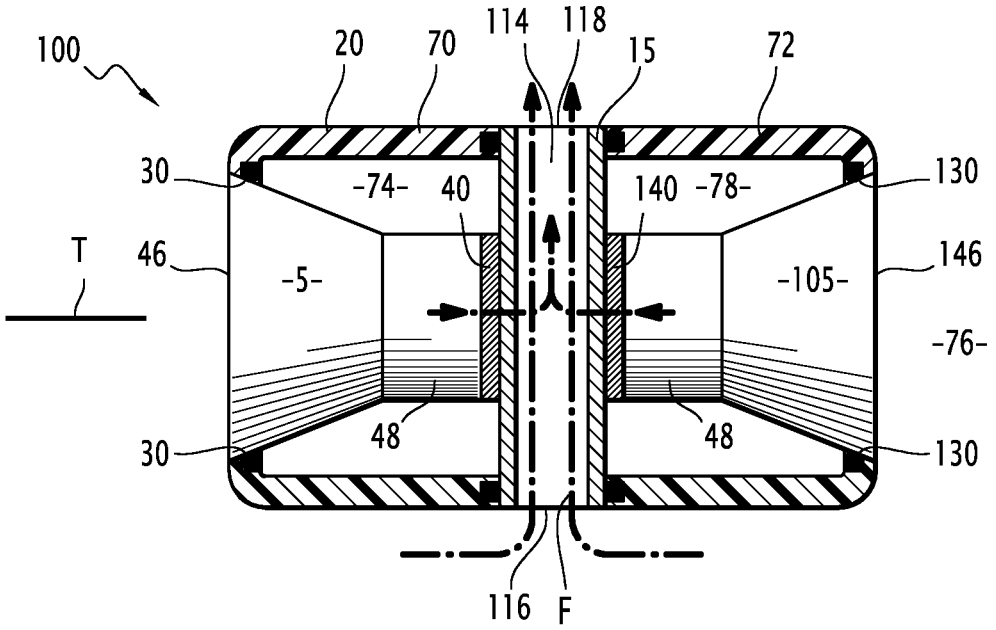
FIG. 3 is a diagrammatic view of the acoustic enclosure shown in FIG. 2, in sectional view along a plane substantially perpendicular to the sectional plane of FIG. 2.
Figure 4:
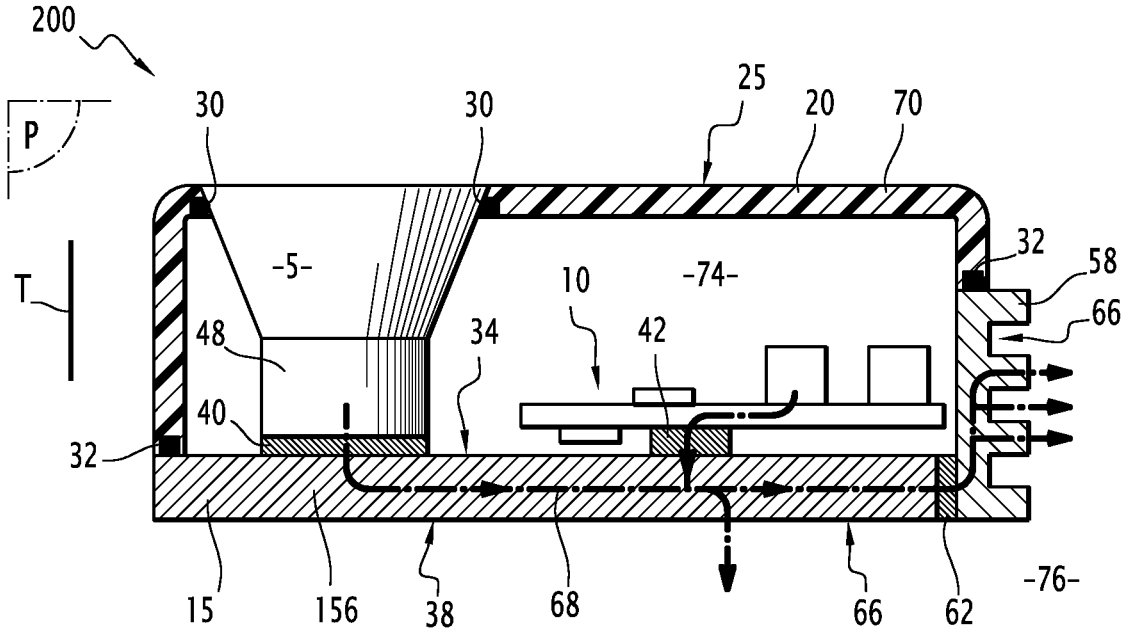
FIG. 4 is a sectional diagrammatic view of an acoustic enclosure according to a third embodiment of the invention.

As shown in FIG. 3, the passage 114 comprises at least one inlet 116 for outside air 76, and an outlet 118. The passage 114 is suitable for allowing a circulation of outside air from the inlet 116 toward the outlet 118.

The member 15 advantageously comprises fins 120 protruding in the passage 114.

Figure 2:
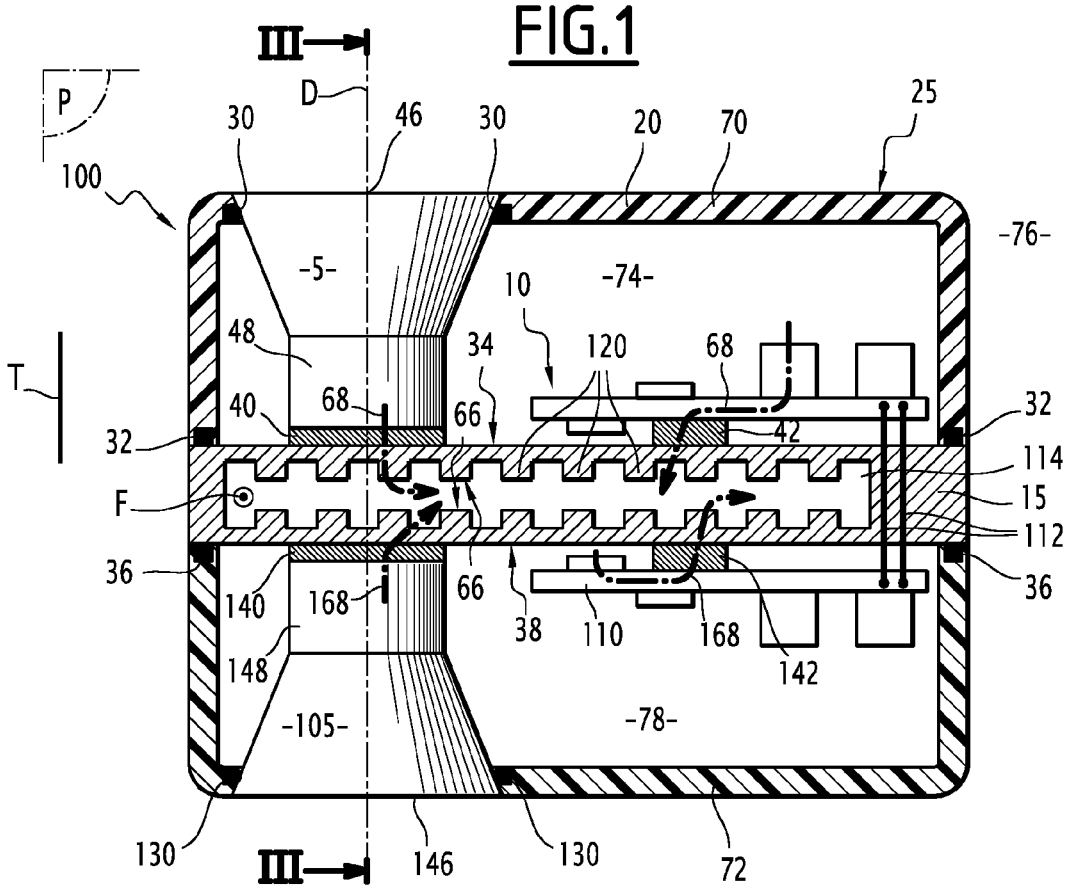
FIG. 2 is a sectional diagrammatic view of an acoustic enclosure according to a second embodiment of the invention.

The circulation of outside air in the passage 114 is embodied in FIGS. 2 and 3 by an arrow F.

The exchange surface 66 defined by the member 15 defines the passage 114.

In a normal usage position of the acoustic enclosure 100, the inlet 116 is situated below the outlet 118.

The passage 114 is suitable for working substantially as a chimney.

The operation of the acoustic enclosure 100 is similar to that of the acoustic enclosure 1, except that the heat flow 68 originating from the motor 48 and the electronic circuit 10 traverses the exchange surface 66 to be carried by the air circulation F.

Likewise, a heat flow 168 originating from the motor 148 and the second electronic circuit 110 traverses the exchange surface 66 to pass into the air circulation F.

According to an alternative that is not shown, the thermal dissipation mode of the acoustic enclosure 100 (chimney) and the thermal dissipation mode of the acoustic enclosure 1 (radiator) are combined.

Alternatively, the acoustic enclosure 100 comprises a fan (not shown) situated in the passage 114 and suitable for creating a forced circulation of outside air in the passage 144.

We will now describe an acoustic enclosure 200 making up a third embodiment of the invention.

The acoustic enclosure 200 is similar to the acoustic enclosure 1 shown in FIG. 1. Similar elements bear identical numerical references. Only the differences between the acoustic enclosure 200 and the acoustic enclosure 1 shown in FIG. 1 will be described in detail below.

The member 15 comprises a connecting portion 156 situated on the surface of the acoustic enclosure 200 so as to partially form the casing 25.

The electronic circuit 10 is situated in the inner volume 74. The second thermal bridge 42 is fastened on the first face 34 of the member 15.

The exchange surface 66 is defined by the radiator 58 and by the second face 38 of the connecting part 156.

When the acoustic enclosure 200 is operating, part of the heat flow 68 originating from the motor 48 and the electronic circuit 10 is discharged in the outside air 76 via the second face 38 of the member 15.

What is claimed is:

1. An acoustic enclosure comprising:

a non-heat-conducting external wall at least partially defining a casing of the acoustic enclosure, at least one electrodynamic loudspeaker including a motor, the loudspeaker having a peripheral portion fastened on the external wall, and at least one electronic control circuit of the loudspeaker, wherein the motor of the loudspeaker and the electronic circuit are connected to a same member of the acoustic enclosure, the member conducting heat and including an exchange surface able to be traversed by a heat flow circulating in the member originating from the motor and the electronic circuit when the acoustic enclosure is operating, the heat flow being intended to dissipate in the air outside the acoustic enclosure or to pass into a heat-conducting element outside the acoustic enclosure, the member includes a radiator defining at least part of the exchange surface, and a connecting portion to which the motor of the loudspeaker and the electronic circuit are connected, the connecting portion being connected to the radiator directly or via a thermal bridge, the connecting portion extends inside the casing, and the radiator lies across on a plane perpendicular to a plane defined by a longitudinal direction and a lateral direction of the connecting portion.

2. The acoustic enclosure according to claim 1, wherein the motor of the loudspeaker is fastened on the member directly or via a chassis of the loudspeaker.

3. The acoustic enclosure according to claim 1, wherein the motor of the loudspeaker or the electronic circuit is or are connected to the member by at least one thermal bridge.

4. The acoustic enclosure according to claim 1, wherein the connecting portion is at least 80 wt % made from metal.

5. The acoustic enclosure according to claim 1, wherein the connecting portion is situated at least partially on the surface of the acoustic enclosure so as to partially form the casing.

6. The acoustic enclosure according claim 1, wherein the member defines at least one passage through the acoustic enclosure, the passage including at least one inlet for outside air, and an outlet, the passage being suitable for allowing a circulation of outside air from the inlet toward the outlet.

7. The acoustic enclosure according to claim 6, comprising a fan to create a forced circulation of outside air in the passage.

8. The acoustic enclosure according to claim 1, wherein the external wall is further fastened on the member, the loudspeaker, the external wall and the member defining an airtight inner volume with respect to the outside air.

9. The acoustic enclosure according to claim 1, wherein the connecting portion is made from metal.

10. The acoustic enclosure according to claim 1, wherein the connecting portion extends through the casing.

11. The acoustic enclosure according to claim 6, wherein the member comprises fins to favor a dissipation of the heat flow in the outside air circulating in the passage.

* * * * *